United States Patent [19]

Kaneko

[11] 4,276,805

[45] Jul. 7, 1981

[54] COVERING WIRE TIGHTENING DEVICE COMPOSITE STRINGS OF PIANOS

[75] Inventor: Yasutoski Kaneko, Hamamatsu, Japan

[73] Assignee: Nippon Gakki Seizo Kabushiki Kaisha, Japan

[21] Appl. No.: 60,975

[22] Filed: Jul. 26, 1979

[30] Foreign Application Priority Data

Jul. 29, 1978 [JP] Japan ..... 53-104946[U]

[51] Int. Cl.[3] ..... G10G 7/00; G10D 3/14

[52] U.S. Cl. ..... 84/458; 84/297 S; 140/123.5

[58] Field of Search ..... 84/297 S, 458–460; 140/123, 123.5

[56] References Cited

U.S. PATENT DOCUMENTS

| | | | |
|---|---|---|---|
| 810,285 | 1/1906 | King | 84/458 |
| 3,099,595 | 7/1963 | Allbaugh | 84/297 S |

*Primary Examiner*—Lawrence R. Franklin

*Attorney, Agent, or Firm*—Lerner, David, Littenberg & Samuel

[57] ABSTRACT

Device for tightening a coiled covering wire of a composite piano string relative to the core wire thereof comprises a spring-loaded operating shaft axially movably encased within an elongated cylindrical main body, the shaft being provided with an outwardly exposable end portion adapted for detachable engagement with the top of a frame pin so that the composite piano string can be transferred to the shaft for twisting. Adjustment of the winding strength of the covering wire relative to the core wire is greatly simplified and stabilized.

7 Claims, 8 Drawing Figures

COVERING WIRE TIGHTENING DEVICE COMPOSITE STRINGS OF PIANOS

BACKGROUND OF THE INVENTION

The present invention relates to a covering wire tightening means or device for composite strings of pianos, and more particularly relates to a means advantageously used for eliminating slack winding of the covering wire on composite strings of pianos in order to improve tonal quality of tones to be generated.

As hereinafter described in more detail, a string for pianos is usually given in the form of a composite string particularly in the bass tone range. Such a composite string includes a core wire and a covering wire wound around the core wire.

It is known that a good tonal quality is obtained when the covering wire is relatively loosely wound around the core wire. However, gaps tend to be left between the wires by such a slack winding. Presence of such gaps generates unnecessary high frequency components when the string is hit by the hammer, thereby having ill influence on tonal quality of the tone to be generated. Therefore, a highly skilled technique is required in order to properly adjust the winding strength of the covering wire.

In order to eliminate such slack winding on a composite string, it is conventional practice to loosen the tuning pin for the ill wound composite string, disengage the composite string from the associated frame pin, twist by hand or suitable pincers the composite string in the winding direction of the covering wire, bring the fastened composite string back into engagement with the frame pin and stretch the composite string by adjusting the tuning pin.

However, strong resistance by the core wire against such twisting makes it quite difficult to successfully adjust the fastening strength of the covering wire in the above-described manner. Slight relaxation of the operator's hands during the adjustment allows easy restoration of the slack winding on the composite string. In addition, space limitation in the piano casing hinder free adjustment of the winding strength by operator's hands.

SUMMARY OF THE INVENTION

It is one object of the present invention to provide a novel device which enables easy and reliable adjustment of winding strength on composite strings of pianos.

It is another object of the present invention to provide a covering wire tightening device which is simple in construction, handy to operate and low in manufacturing cost.

In accordance with the present invention, a spring-loaded operating shaft is axially movably arranged in the elongated hollow main body with its end being exposable out of the main body, and the exposable end is adapted for provisional engagement with the top of a frame pin so that the hooking end of the composite string can be transferred from the frame pin to the exposable end of the operating shaft for twisting. The exposable end is made up of two sections, the one section directly engageable with the pin top being larger in cross-section diameter than the other section.

DESCRIPTION OF THE PREFERRED EMBODIMENTS

Figure 1:
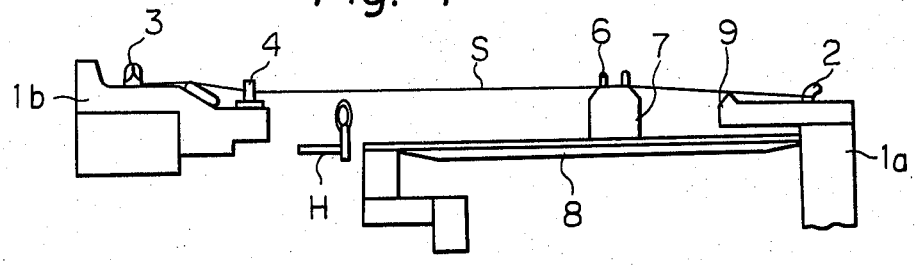
FIG. 1 is a side view schematically showing composite strings in stretched state and their related parts.
Figure 2:
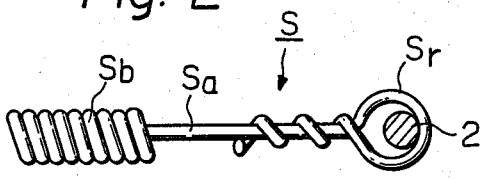
FIG. 2 is a top view, partly in section, of a composite string hooked on a frame pin.

Strings on a piano act as a kind of tone generators and are arranged in stretched state on a piano frame. One example of such an arrangement for the bass range on a grand piano is shown in FIGS. 1 and 2. A number of frame pins 2 are arranged in line with each other on a frame pin section 1*a* of the metallic piano frame and a like number of tuning pins 3 are arranged in line with each other on a tuning pin section 1*b* of the piano frame which is spaced from the frame pin section 1*a* in the running direction of strings S. Each string S is coupled, at one end, to an associated tuning pin 3 and, at its other end, to an associated frame pin 2. At a position near the tuning pin 3, the string S engages an agraffe 4 and, at a position near the frame pin section 1*a*, is placed in engagement with bridge pins 6 arranged on a bridge 7 which is in turn mounted on a horizontally arranged sound board 8. The string S further passes by a stringing pillow 9 on the frame pin section 1*a* before coupling to the frame pin 2 which is in general bent or inclined opposite to the stretching area of the string S. Tension of each string is adjusted by axially turning the associated tuning pin 3. A hammer H is arranged below each string S at a position close to the tuning pin section 1*b*.

In order to obtain sufficient frequency for the tonal pitch to which each string S corresponds, it is necessary to provide the string S with a proper linear density. From this point of view, each string S is usually provided in the form of a composite string. That is, as shown in FIG. 2, a composite string S is made up of a core wire Sa and a covering wire Sb wound around the core wire Sa either by single or double winding.

A wire having a high rigidity and good sound productivity is used for the core wire Sa, which is generally called as "a music wire". A wire having a low hardness and suited for deformation is used for the covering wire Sb, which is made mainly of copper. The covering wire Sb is wound around the core wire Sa over the length between the agraffe 4 and the bridge 7. This length is generally known as "the effective vibratory length of a string". A ring Sr is formed by the core wire Sa at the frame pin side end of the string S, which engages with the frame pin 2.

Figure 3:
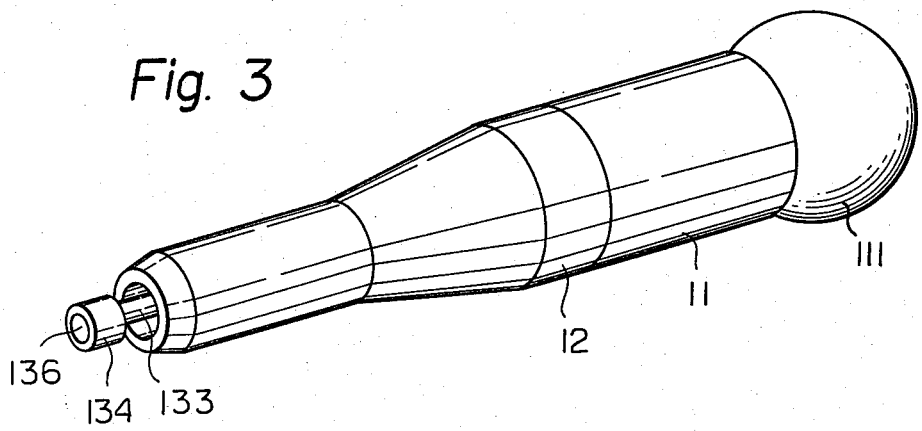
FIG. 3 is a perspective view of a novel device in accordance with the present invention.
Figure 4:
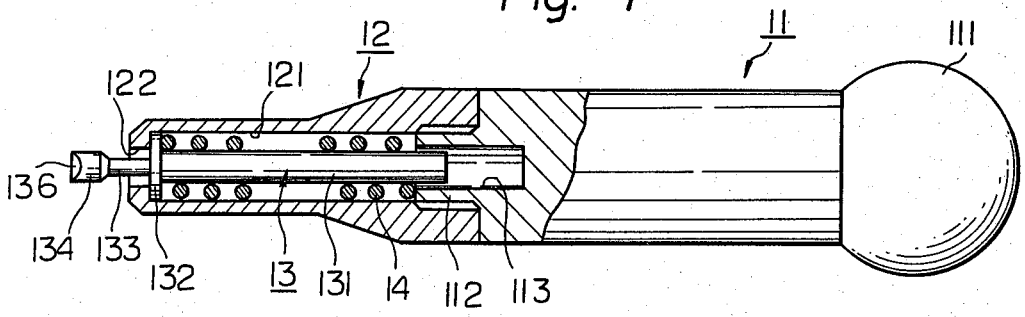
FIG. 4 is a side view, partly in section, of the device shown in FIG. 3, and FIGS. 5A to 5D are side views showing how to tighten the covering wire of a composite string using the device in accordance with the present invention.

An embodiment of the covering wire tightening means in accordance with the present invention is shown in FIGS. 3 and 4. The means comprises, as major elements, a holding rod 11, a cylindrical head 12 coaxially coupled to the holding rod 11, an operating shaft 13 axially movably inserted into the cylindrical head 12, and a compression spring 14 accompanying the operating shaft 13.

The holding rod 11 is provided, at its one end, with a spherical knob 111 for stable handling by the operator's hand and, at its the other end, with a center projection 112 of a smaller diameter. The center projection 112 is provided on its outer surface with a male thread. An axial hole 113 is formed in the center projection 112.

The cylindrical head 12 is provided with an elongated circular hole 121. This circular hole 121 is threaded at one open end thereof for screw engagement of the holding rod 11 with the cylindrical head 12. On the other end, this circular hole 121 merges into a short hole 122 of a smaller diameter.

The operating shaft 13 includes a stem 131, a flange 132 formed at one end of the stem 131, a rod 133 axially coupled at its one end to the opposite surface of the flange 132, and a tip 134 formed at the other end of the rod 133.

The diameter of the stem 131 is somewhat smaller than that of the axial hole 133 formed in the holding rod 11. The diameter of the flange 132 is somewhat larger than that of the short hole 122 of the cylindrical head 12. The diameter of the rod 133 is smaller than that of the tip 134.

The diameter of the tip 134 is somewhat smaller than that of the short hole 122 of the cylindrical head 12. As hereinafter described in more detail, the tip 134 is adapted for pressure engagement with the head of a frame pin 2. In the case of the illustrated embodiment, a hemispherical hollow 136 is formed in the free end of the tip 134 for the above-described engagement. However, in accordance with the design of the frame pin head, the tip free end may take another form. For example, any projection may be formed on the tip free end when a corresponding hollow is formed in the top of a frame pin 2.

The coiled compression spring 14 is inserted into the elongated hole 121 of the cylindrical head 12 whilst surrounding the stem 131 of the operating shaft 13. One end of the compression spring 14 abuts against the end of the center projection 112 of the holding rod 11 and the other end abuts against the flange 132 of the operating shaft 13. Thus, the operating shaft 13 is resiliently forced to move towards the open end of the holding head 12 but the movement is limitted by contact of the flange 132 with the end wall of the holding head 12 delineating the short hole 122.

The tightening operation of the covering wire of a composite string by means of the above-described tightening device will hereinafter be explained with reference to FIGS. 5A to 5D.

Figure 5A:
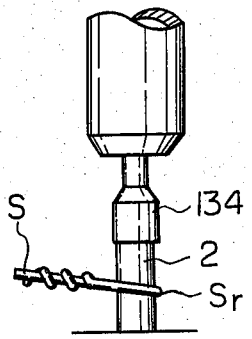
Figure 5B:
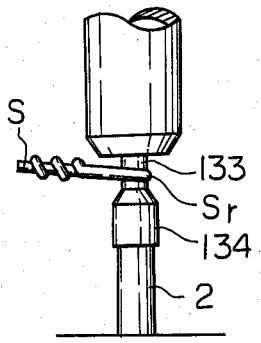
Figure 5C:
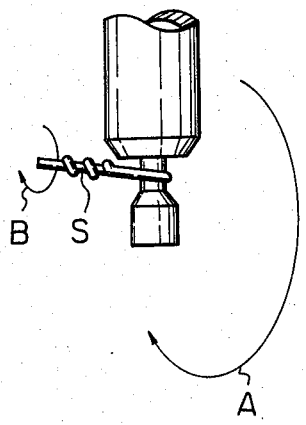

Before starting the operation, a tuning pin for the slack composite string S is loosened in order to lower the tension of the composite string S. While keeping this low tension state, the tip 134 of the tightening device is brought into engagement with the top of a corresponding frame pin 2 as shown in FIG. 5A. In this engaged state, the ring Sr of the composite string S is pushed upwards so that same is brought into engagement with the rod 133 of the operating shaft 13 passing by the tip 134 as shown in FIG. 5B. That is, the composite string S has been transferred from the frame pin 2 to the device of the present invention. Due to the presence of the tip of the larger diameter, unexpected falling of the ring Sr from the device can be well prevented.

Next the tightening device is somewhat lifted in order to detach the tip 134 from the top of the frame pin 2. Then, as shown with an arrow A in FIG. 5C, the device with the composite string S is turned about the longitudinal axis of the composite string S in the winding direction of the covering wire Sb shown in FIG. 2. By this turning of the device, the composite string S is twisted in the same direction as shown with an arrow B, the covering wire Sb thereby being tightened with respect to the core wire Sa for a better contact.

Figure 5D:
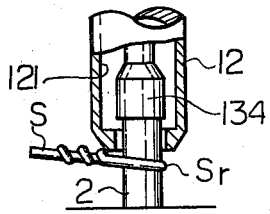

After the tightening of the covering wire is complete, the tip 134 is again brought into engagement with the top of the frame pin 2 and the device is pressed downwards. Then the tip 134 is pushed into the elongated hole 121 of the cylindrical head 12 while overcoming repulsion by the compression spring 14 as the cylindrical head 12 moves downwards. By this downward movement of the head 12, the ring Sr of the composite string S resting on the rod 133 is thrust downwards by the open end of the head 12 and transferred onto the frame pin 2 passing by the tip 134 of the operating shaft 13 as shown in FIG. 5D. By adjusting the tuning pin 3, the string is again properly stretched in order to generate a tone of the prescribed tonal pitch.

In accordance with the present invention, the operation necessary for adjustment of winding strength on composite strings is greatly simplified due to use of a handy but reliably operable tightening means. The low manufacturing cost caused by a simple construction of the device enables easy introduction of the device into maintenance and/or adjustment of pianos.

I claim:

1. A covering wire tightening device for composite strings of pianos comprising:

an elongated cylindrical main body open in one end thereof, and a spring-loaded operating shaft axially movably encased within said main body with one end portion being axially exposable out of said main body via said open end, the free end of said one end portion being adapted for engagement with the top of a frame pin, said one end portion being made up of a first section which includes said free end and a second section which is remote from said free end, and said first section being larger in cross-sectional diameter than said second section.

2. A device as claimed in claim 1 in which said operating shaft further includes a flange within said main body whose maximum contour is larger than that of the opening in said open end of said main body.

3. A device as claimed in claim 1, or 2 in which said operating shaft is resiliently urged to move out of said main shaft.

4. A device as claimed in claim 3 in which said free end of said one end portion is provided with a hollow patterned after said top of said frame pin.

5. A device as claimed in claim 3 in which said free end of said one end portion is provided with a projection patterned after said top of said frame pin.

6. A device as claimed in claim 1 or 2 in which said free end of said one end portion is provided with a hollow patterned after said top of said frame pin.

7. A device as claimed in claim 1 or 2 in which said free end of said one end portion is provided with a projection patterned after said top of said frame pin.

* * * * *

UNITED STATES PATENT AND TRADEMARK OFFICE

CERTIFICATE OF CORRECTION

PATENT NO. : 4,276,805

DATED : July 7, 1981

INVENTOR(S) : Yasutoski Kaneko

It is certified that error appears in the above-identified patent and that said Letters Patent are hereby corrected as shown below:

Column 2, line 11, "5D" should read -- 5C --.

Column 3, line 17, "133" should read --113--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*